US005515628A

United States Patent [19]

Rankin

[11] Patent Number: 5,515,628

[45] Date of Patent: May 14, 1996

[54] FIRE-RESISTANT JACKET FOR USE IN A METHOD OF FRAMING A PICTURE

[75] Inventor: Clifford E. Rankin, London, England

[73] Assignee: Rankins (Glass) Co., Ltd., London, England

[21] Appl. No.: 191,208

[22] Filed: Feb. 3, 1994

[30] Foreign Application Priority Data

Feb. 3, 1993 [GB] United Kingdom ..... 9302137

[51] Int. Cl.[6] ..... G09F 7/00

[52] U.S. Cl. ..... 40/700; 40/790

[58] Field of Search ..... 40/152, 152.1, 40/156, 611, 606

[56] References Cited

U.S. PATENT DOCUMENTS

| | | | |
|---|---|---|---|
| 4,158,266 | 6/1979 | Gilmour | 40/152 |
| 4,170,080 | 10/1979 | Bergh et al. | 40/152 |
| 4,194,313 | 3/1980 | Downing | 40/610 |
| 4,284,296 | 8/1981 | Evans | 40/64 Z |
| 4,583,309 | 4/1986 | Kane . | |
| 4,646,914 | 3/1987 | Gipson . | |
| 4,809,454 | 3/1989 | Weismann | 40/611 |
| 5,125,175 | 6/1992 | Pilkington . | |

FOREIGN PATENT DOCUMENTS

| | | |
|---|---|---|
| 0494548 | 7/1992 | European Pat. Off. . |
| 296022 | 11/1915 | Germany . |
| 2533892 | 5/1977 | Germany . |
| 320736 | 10/1929 | United Kingdom . |
| 639955 | 7/1950 | United Kingdom . |
| 1513625 | 6/1978 | United Kingdom . |

*Primary Examiner*—Kenneth J. Dorner
*Assistant Examiner*—Cassandra Davis
*Attorney, Agent, or Firm*—Oliff & Berridge

[57] ABSTRACT

A protective jacket for use in a method of framing a picture. The jacket is designed to fit within the existing frame of the picture, allowing the picture to be viewed under near optimal conditions whilst affording protection against fire or impact damage. The jacket comprises a fire-resistant laminated glazing material for viewing the picture and a metal sub-frame for providing impact resistance. The jacket may also be air-tight or water-tight.

10 Claims, 2 Drawing Sheets

FIRE-RESISTANT JACKET FOR USE IN A METHOD OF FRAMING A PICTURE

The present invention relates to a fire-resistant jacket for use in a method of framing a picture. In particular, the present invention relates to a fire-resistant jacket to fit within the existing frame of a painting, a drawing, a photograph or the like.

In situations where a picture is exhibited, either in a private collection or in a public gallery, there is invariably an attendant risk of damage to the picture as a result of a fire. However slight the risk may be, the consequences of fire damage to a valuable work of art can be very serious indeed.

Conventional fire prevention methods are not always appropriate in circumstances where pictures are on display. Sprinkler systems, for example, are often used in open areas of public buildings to prevent the spread of fire. However, the associated risk of water damage to valuable paintings makes the use of such systems undesireable in many cases. In addition, the use of containment techniques, such as partitioning an area of a building into separate sections each sealed off by fire doors, is frequently impractical in open public galleries.

An alternative approach is to enclose each picture in a transparent case made of a fire-resistant glazing material. However, the presence of such a case surrounding a framed picture can be obtrusive and may detract from the aesthetic appreciation of the picture itself. It is an object of the present invention to provide a method of protecting a picture that is unobtrusive, and that allows the protected picture to be displayed under near optimal conditions.

Accordingly, in a first aspect of the invention, there is provided a method of framing a picture for display, wherein the picture is enclosed within a protective jacket and the jacket is located within a frame. In a first step, the picture may be located in the jacket, and then in a second step, the jacket located within the frame, or vice versa. A picture in the context of the invention described is taken to include a painting, drawing, sketch, photograph, graphic work, illustration, chart, map, collage, engraving, etching, woodcut, tapestry or other like work.

According to a second aspect of the invention, there is provided a picture for display in a frame, wherein said picture is enclosed within a protective jacket dimensioned or arranged for retention within the frame.

According to a third aspect of the invention, there is provided a protective jacket for use in a method in accordance with the first aspect of the invention. Preferably, in any aspect of the invention, the jacket is located or arranged for retention in a frame, with any visually obstructive portions thereof hidden from display. The protective jacket in any aspect of the invention can be designed to afford protection to the picture from fire. In an embodiment, the jacket is both fire-resistant, in the sense that it resists or retards the spread of fire, and capable of insulating the picture contained within from a heat source applied to the outside of the jacket. (Wherever the term "fire-resistant" is used in this specification, it is intended to have the foregoing meaning). Thus, in the event of a fire, although the outer surface of such a protective jacket may become very hot, the rate of transfer of heat through the jacket to the picture contained within is very low.

In a preferred embodiment, the jacket is also strong enough to withstand mechanical impact as may occur in a fire from falling objects or otherwise. Such impact resistance may be imparted by providing the jacket with a rigid sub-frame. Preferably the rigid sub-frame is dimensioned so as to be hidden from display by the frame, in which it is accommodated. In an especially preferred embodiment this sub-frame is made of rolled steel members. In a more preferred form of the invention, the protective jacket comprises a panel of fire-resistant, laminated glazing material for viewing the picture. Suitable fire-resistant laminated glazing materials may be obtained from Rankins (Glass) Company Limited, of Hackney, London, sold under the Trade Mark "PYROCLEAR". The laminated glazing material may comprise two outer layers of float glass, which each have outerly facing non-reflective surfaces, sandwiching two inner layers of float glass which, in turn, sandwich a single layer of clear intumescent material. The layer of intumescent materials binds the two inner layers of float glass together. The outer layers of float glass are bound to the inner layers of float glass by thinner layers of a cured polyester resin. With this structure, the glazing material is fire-resistant and non-reflective.

The jacket can be arranged to protect a picture from adverse atmospheric effects, such as excessive humidity or arridity and air-bourn pollution. Thus, in a further embodiment, the protective jacket can form a sealed unit which may be water tight and, if required, air-tight. In certain cases, it may be desireable for the unit to be only partially sealed, thus allowing equilibration between ambient conditions, such as air humidity, and the conditions inside the unit.

An embodiment of the invention will now be described in detail, by way of example only, with reference to the accompanying drawings, wherein.

Figure 1:
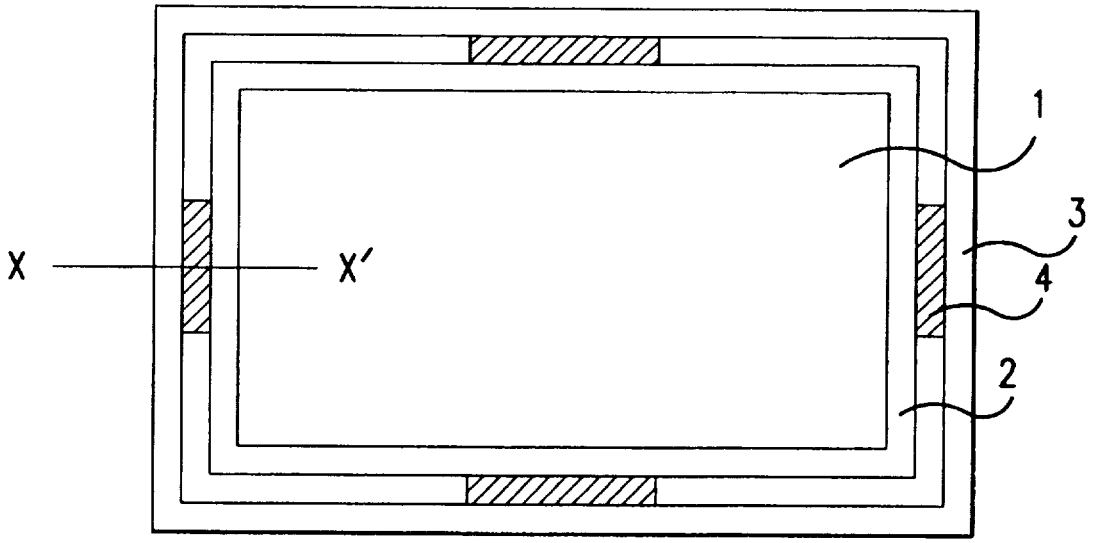
FIG.1 PRIOR ART
FIG. 1 shows a rear view of an oil painting on a canvas in a conventional decorative frame.
Figure 2:
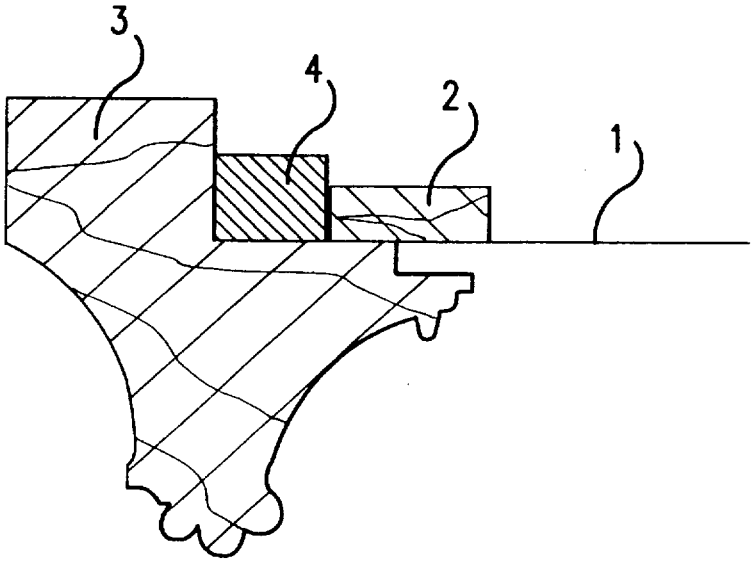
FIG.2 PRIOR ART
FIG. 2 shows a partial cross-sectional view of the framed painting shown in FIG. 1 along the line XX'.

With reference to FIGS. 1 and 2, an oil painting on a canvas 1 is supported under tension on a stretcher 2. A decorative frame 3 provides a surround for the canvas 1, which is held in place by four spacer blocks 4, positioned between the frame 3 and the stretcher 2.

Figure 3:
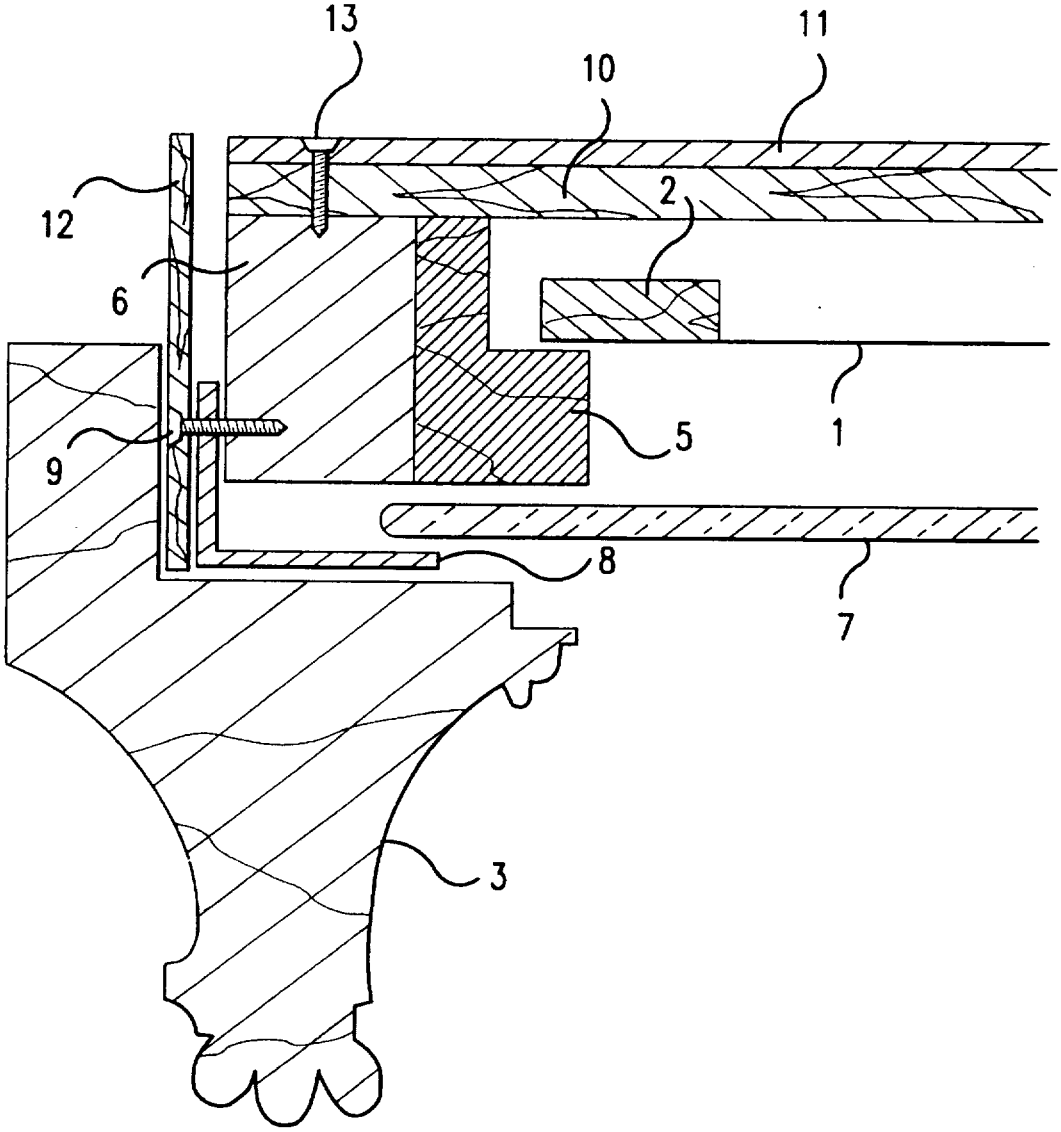
FIG. 3 shows a partial cross-sectional view of a painting in a fire-resistant protective jacket according to the invention, fitted within a conventional frame.

With reference to FIG. 3, an oil painting on a canvas 1 is shown supported on a stretcher 2, within a decorative frame 3. The painting 1, stretcher 2 and frame 3 are of similar dimensions to the corresponding components illustrated in FIGS. 1 and 2. A rectangular sub-frame 6, formed from rectangular section tubular steel is lined with a rectangular fire-resistant lining 5, formed from "L" section seasoned hardwood, and both the sub-frame 5 and lining 5 are located between the frame 3 and the stretcher 2. A rectangular panel of fire-resistant laminated "PYROCLEAR" glass 7 is positioned in front of the canvas and held to the sub-frame 6 by angle brackets 8 (only one of which is shown) which are attached to the sub-frame 6 by a plurality of screw 9 (only one of which is shown).

A rear rectangular panel 10 of "CAPE BOARD" is attached to the sub-frame 6 by a plurality of screws 13 (only one of which is shown). "CAPE BOARD" is fire-resistant and has very low radiation properties and may be obtained from Cape Board Products Limited of. The support screws 9 and 13 also pass through and respectively retain four outer side panels 12 (only one of which is shown), which extend around the periphery of the sub-frame 6, and an outer rear panel 11, all formed of hardwood. The assembly of sub-frame 6, lining 5, panel of fire resistant glazing material 7, retaining brackets 8, rear panel 10 and outer panels 11 and 12 together comprise a protective jacket, enclosing the painting 1, which fits within the decorative frame 3.

The invention as described in the foregoing example is not intended to be limited to the particular materials and method of construction disclosed therein.

I claim:

1. A protective jacket for a picture, comprising:

a front portion made of a fire-resistant, non-reflective, laminated glazing material;

a back portion; and a side portion connecting the front and back portions, wherein said jacket is fire-resistant and capable of insulating a picture from a heat source, said side portion comprises a metal sub-frame and a fire-resistant hardwood layer to insulate a picture from said metal sub-frame, and said rear portion comprises a rear panel made of a fire-resistant, low-radiative material.

2. A protective jacket as claimed in claim 1, further comprising an outer layer of hardwood.

3. A framed picture comprising a protective jacket as claimed in claim 1, a picture, and an outer frame.

4. The framed picture according to claim 3, wherein the jacket is dimensioned for retention within the outer frame.

5. A picture frame assembly comprising a protective jacket as claimed in claim 1, and an outer frame, wherein said jacket is dimensioned for retention within said outer frame.

6. A protective jacket for a picture, comprising:

a front portion formed of a fire-resistant, non-reflective, laminated glazing material;

a metal sub-frame connected to the front portion;

a hardwood layer to insulate a picture from said metal sub-frame;

a rear panel of fire-resistant, low-radiative material; and an outer layer of hardwood, wherein said jacket is fire-resistant and capable of insulating a picture from a heat source.

7. A protective jacket as claimed in claim 6, wherein said laminated glazing material comprises a first, second, third and fourth layers, wherein said first and second layers are glass, said third layer is a clear intumescent material, and said fourth layer is a non-reflective material, further wherein said first and second layers sandwich said third layer, and said fourth layer forms a non-reflective surface of said glazing material.

8. A method of protectively framing a picture for display, comprising:

a) enclosing said picture within a fire-resistant protective jacket capable of insulating said picture from a heat source, said jacket comprising a front portion formed of a fire-resistant, non-reflective, laminated glazing material, a side portion comprising a metal sub-frame and a hardwood layer to insulate the picture from said metal sub-frame, and a rear portion comprising a rear panel made of a fire-resistant, low-radiative material; and b) positioning the protective jacket with an outer frame.

9. A method as claimed in claim 8, wherein said protective jacket includes a visually obstructive portion, further comprising hiding said visually obstructive portion from display.

10. A method as claimed in claim 9, further comprising hiding said sub-frame from display with said outer frame.

* * * * *